United States Patent [19]

Brossard

[11] Patent Number: 4,475,542

[45] Date of Patent: Oct. 9, 1984

[54] METHOD OF CHIROPRACTIC TREATMENT AND SHAPED BLOCKS THEREFOR

[76] Inventor: André Brossard, 964 rue Charlevoix Boucherville, Quebec J4B 6J7, Canada

[21] Appl. No.: 469,694

[22] Filed: Feb. 25, 1983

Related U.S. Application Data

[63] Continuation-in-part of Ser. No. 215,360, Dec. 11, 1980, abandoned.

[51] Int. Cl.[3] ..... A61H 39/00

[52] U.S. Cl. ..... 128/69; 128/68; D6/597; 5/431

[58] Field of Search ..... 128/69, 68, 70, 75, 128/78, 82; 5/431–432, 436–437, 443, 445, 446; 2/44, 45; 297/396, DIG. 1, DIG. 2; D6/200–202; D24/36, 99

[56] References Cited

U.S. PATENT DOCUMENTS

| | | | |
|---|---|---|---|
| D. 254,029 | 1/1980 | Barbagallo | 5/436 X |
| 726,055 | 4/1903 | Hartford | 128/69 |
| 1,934,918 | 11/1933 | Everson | 128/69 |
| 2,818,856 | 1/1958 | Johnson | 128/69 |
| 3,555,582 | 1/1971 | Radford | 5/436 |

FOREIGN PATENT DOCUMENTS

| | | | |
|---|---|---|---|
| 2009792 | 3/1970 | Fed. Rep. of Germany | 5/437 |

*Primary Examiner*—Richard J. Apley
*Assistant Examiner*—Chris Coppens
*Attorney, Agent, or Firm*—Oblon, Fisher, Spivak, McClelland & Maier

[57] ABSTRACT

A block intended for chiropractic treatment which comprises a base; an end face substantially perpendicular to said base at one end of said base; an oblique portion extending substantially from the top of said end face downwardly to substantially the other end of said base; lateral faces connecting said base, said end face and said oblique portion. A method of chiropractic treatment with a person lying on his back which comprises providing blocks as defined above, inserting one block underneath said person so as to rest one femoral head on one side of said person against said oblique portion of said one block, said one block being oriented towards the upper part of the body of said person, inserting a second block underneath said person with the oblique portion of said block at the level of the iliac crest on the other side of said person, said second block being in line with said first block but oriented towards the lower part of the body of said person, said treatment lasting about ten minutes.

2 Claims, 3 Drawing Figures

METHOD OF CHIROPRACTIC TREATMENT AND SHAPED BLOCKS THEREFOR

CROSS-REFERENCE

This application is a continuation-in-part of application Ser. No. 215,360, filed Dec. 11, 1980, now abandoned.

BACKGROUND OF INVENTION

1. Field of the Invention

This invention relates to a method of chiropractic treatment and shaped blocks therefor.

2. Description of Prior Art

A true right-handed person always has the tendency to work or do any physical activity on his right side at least 90% of the time. When this person starts to walk after a working session or a physical work-out, he needs at least one hour to readjust his muscular system. The same is true for the left side of a left-handed person. The muscular system therefore has a tendency to pull the right hip (in the case of a right-handed person) downwardly, thus producing a stress, thus affecting the region of the lower lumbar vertebrae. Since those vertebrae are responsible for the entire nervous system of the lower part of the body, which eventually affects the nervous system at the level of the neck, serious headaches or other discomfort or fatique result at the end of the day. When going to bed, the weight of the body will force the hip to restabilize in the normal position of the lower body and a normal person will therefore feel relieved. However, as the years go by, the muscles never completely regain the normal position with the result that there is always some kind of subluxation remaining which eventually affects the cervical and dorsal regions of the body.

There is therefore a need of a treatment which will compensate for the incomplete stabilization obtained when sleeping.

It is therefore an object of the present invention to provide a treatment enabling a person to be relieved of the discomfort arising from a slight displacement of the pelvic portion of the body.

It is another object of the present invention to provide especially shaped blocks which are suitable to perform such treatments.

SUMMARY OF INVENTION

In accordance with the present invention, there is provided a block intended for chiropractic treatment which comprises a base formed of a trapezoidal portion and a rectangular portion, unitary with said trapezoidal portion at the longer base of said trapezoidal portion; a first substantially rectangular end face perpendicular to said base and merging with the end of said rectangular portion of said base; an upper face parallel to said base and having the same dimensions as said rectangular portion of said base; rectangular lateral faces connecting said base, said end face and said upper face; a second substantially rectangular end face perpendicular to said base and merging with the shorter base of said trapezoidal portion; an oblique portion between said upper face and said second end face, said oblique portion being generally inclined at about 60° with respect to the vertical and comprising a first upper inwardly curved section descending from the inner edge of said upper face; a substantially intermediate flat 60° trapezoidal face portion following said first upper curved section; said trapezoidal flat portion being lifted at its lower end so as to form an angle of between about 7° and 9° with respect to the plane of said oblique portion; a second lower inwardly curved section between said intermediate flat face and said second end face; and irregular lateral faces connecting said base, said oblique portion, said rectangular lateral faces and merging into said second rectangular end face.

Also according to the invention there is provided a method of chiropractic treatment with a person lying on his back which comprises providing blocks as defined above, inserting one block underneath said person so as to rest one femoral head on one side of said person against said oblique portion of said one block, said one block being oriented towards the upper part of the body of said person, inserting a second block underneath said person with the oblique portion of said block at the level of the iliac crest on the other side of said person, said second block being in line with said first block but oriented towards the lower part of the body of said person, in such a manner that for each said one and said second blocks, the trapezoidal flat portion presses against the belly of a respective gluteus maximum, while said first and second inwardly curved portion respectively receive portions of the gluteus maximum on both sides of the said belly, thereby bringing about a similar extension of the gluteus maximum on both sides of said belly, said treatment lasting about ten minutes.

BRIEF DESCRIPTION OF DRAWINGS

The invention will now be illustrated by means of the following drawings, it being understood that they are only given for the purpose of illustration and not for restricting the scope of protection which is defined by the appended claims.

In the drawings.

Figure 1:
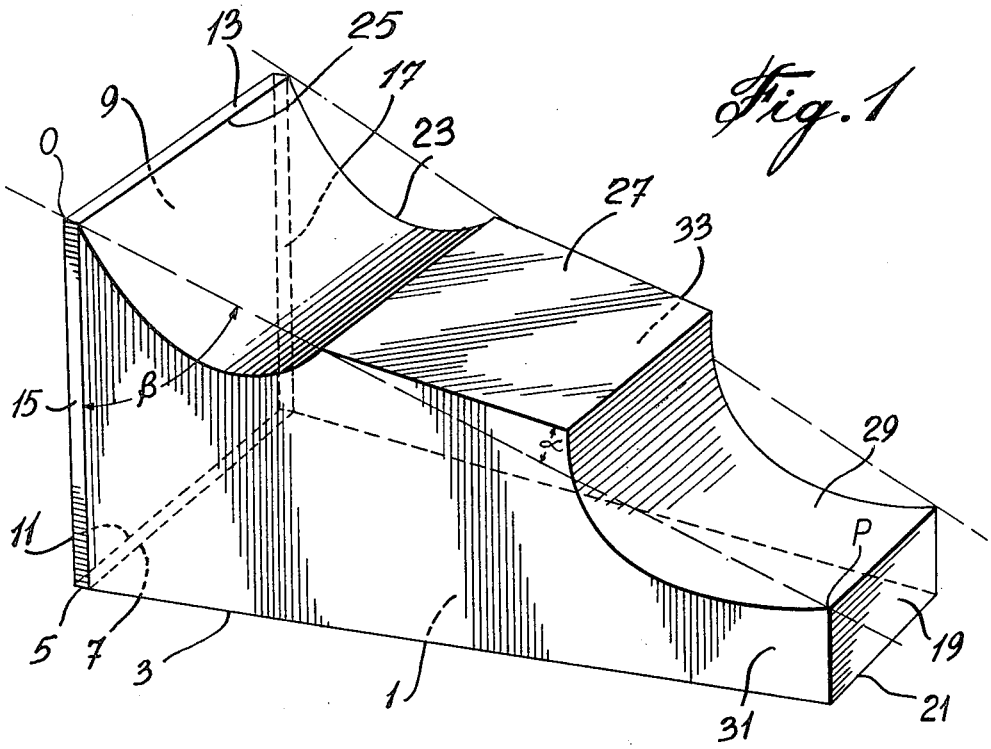
FIG. 1 is a perspective view of a block which can be used for the chiropractic treatment according to the invention.

Referring to the drawings, particularly FIG. 1, the block illustrated comprises a base 1 which has a particular shape. It is formed of a trapezoidal portion 3 and a rectangular portion 5, the latter being unitary with the trapezoidal portion 3 at the longer base 7 of the trapezoidal portion 3. The block is also formed of an end face 9 which, as shown, is perpendicular to the base 1 and merges with the end 11 of the rectangular portion 5 of the base 1.

The block also consists of an upper face 13 which, as shown, is also rectangular and has the same dimensions as the rectangular portion 5 of the base 1. Of course, upper face 13 and rectangular portion 5 are parallel to one another.

There are rectangular lateral faces 15 and 17 as shown, which connect the base, at the rectangular portion, the end face 9 and the upper face 13. The smaller end of the block 1 has a rectangular end face 19 which is perpendicular to the base 1 and merges with the shorter base 21 of the trapezoidal portion 3.

The working portion of the block consists of an oblique portion which appears between the upper face 13 and the second end face 19. The oblique portion comprises a first inwardly curved section 23 which descends from the inner edge 25 of the upper face 19. Next, there is a flat face 27 which is trapezoidal.

If an imaginary line is drawn between point O of the block where faces 13, 15 and 31 and curved section 23 meet and point P where faces 21 and 31 and curved section 29 meet, this line should form an angle B of approximately 60° with respect to the vertical. Turning now to trapezoidal face 27, it will be realized that instead of following the general oblique plane defined by the imaginary line OP, its lower end is slightly lifted. The result is that the trapezoidal face 27 forms an angle $\alpha$ with respect to the oblique plane defined by the imaginary line OP, said angle $\alpha$ varying between about 7° and 9°.

It will therefore be realized that the chiropractic block 1 which is generally trapezoidal has a facial angulation of about 60°, including a central rest defined by the trapezoidal face 27 which is slightly lifted with respect to the plane defined by the imaginary line OP, to the extent that it forms an angle $\alpha$ between about 7° and 9° with respect to said plane. This particular shape is especially adapted to contract and relax the periformis, psoas and gluteus medius (lower back) muscles. These muscles work towards the stabilization and the maintaining in position of the lumbar muscular belt of the lower back. When the sacral region is affected by a contraction, there is an automatic reaction on the small multifidus muscle whose origin is in the sacral region, more specifically on the posterior face of the sacrum, the medial surface of the posterior iliac spine and the posterior sacroiliac ligament. The reaction proceeds from the lumbar region to the thoracic region and finally to the cervical region.

Considering the place of origin and of insertion of the lower back muscles, i.e. the multifide, the rotatores, the interspinales and the intertransversarii, it is therefore imperative that these blocks be utilized at the level of the lumbar region in order to regularly correct the muscular stresses of the lumbar region of the body, thus improving the general health of the human body.

Finally, the oblique portion comprises a second inwardly curved section 29 which appears between the flat face 27 and the end face 19.

Figure 3:
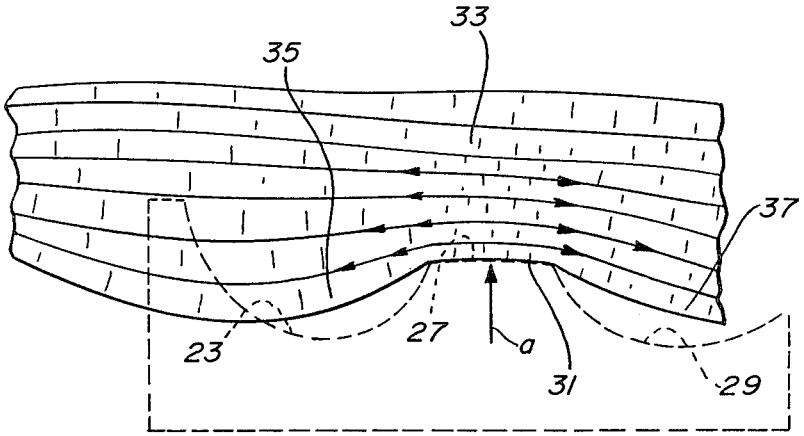
FIG. 3 is a view showing the positioning of the gluteus maximum on the block during treatment.

With particular reference to FIG. 3 of the drawings, it will be seen that in practice the trapezoidal face 27 exerts a peak contraction, for example two to three pounds of pressure, in the direction indicated by the arrow a against the belly 31 (spindle cell fibres) of the gluteus maximus 33. At the same time, the two inwardly curved sections 23 and 29 receive portions 35, 37 of the gluteus maximus which are found on both sides of the belly 31, thereby bringing about a similar extension of the gluteus maximus 33 on both sides of the belly 31.

The net result is that there is obtained a specific stabilization of the gluteus maximus and consequently of the gluteus medius (not shown) and of the gluteus minimus (not shown) which are located immediately underneath the gluteus maximus.

As used in the present context, the term stabilization means the act of improving the tonicity of a muscle, in the present case the gluteus maximus and associated muscles.

With respect to the inwardly curved portions, they are used more specifically as stretchers of muscle spindle cells, so as to bring more stimulus and therefore equal tension at the Golgi corpuscle receptors, thereby enabling the muscle to restore its normal function.

To complete the block, there are irregular lateral faces 31 and 33 which connect the base 1, the oblique portion 27 and the rectangular lateral faces 15 and 17. The lateral faces merge into the second rectangular end face 19.

Figure 2:
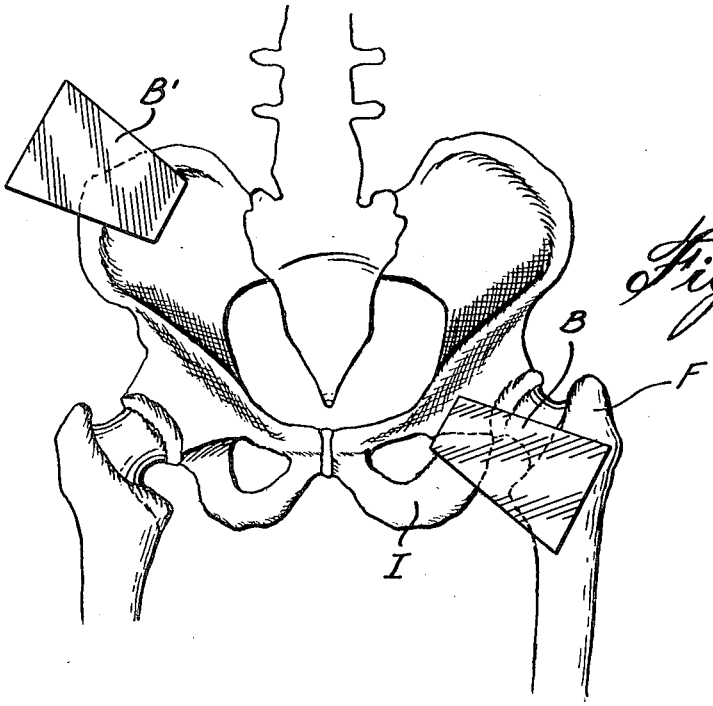
FIG. 2 is a view showing the use of the blocks.

In operation, which will be illustrated by FIG. 2 of the drawings, if there is a deviation caused by an extensive use of the left side, a person who is going to be submitted to a chiropractic treatment will lie on his back. A block B will be inserted underneath the person so as to rest on the left femoral head F of the person against the oblique portion of the block. It will be noted that the block is oriented towards the upper part of the body of the person with the smaller end extending inwardly. Then, a second block B′ is inserted underneath the person with the oblique portion being placed at the level of the iliac crest on the right side of the person, the second block B′ being in line with the first block B, but being oriented towards the lower part of the body of that person. The blocks B and B′ will be placed in such a manner during the treatment that for each block the trapezoidal flat portion 27 will press against the belly 31 of a respective gluteus maximus, while the two inwardly curved portions 23 and 29 will respectively receive portions 35, 37 of the gluteus maximus on both sides of the belly 31, thereby bringing about a similar extension of the gluteus maximus on both sides of the belly 31.

I claim:

1. Block intended for chiropractic treatment which comprises:

a base formed of a trapezoidal portion and a rectangular portion, unitary with said trapezoidal portion at the longer base of said trapezoidal portion;

a first substantially rectangular end face perpendicular to said base and merging with the end of said rectangular portion of said base;

an upper face parallel to said base and having the same dimensions as said rectangular portion of said base;

rectangular lateral faces connecting said base, said end face and said upper face;

a second substantially rectangular end face perpendicular to said base and merging with the shorter base of said trapezoidal portion;

an oblique portion between said upper face and said second end face, said oblique portion being generally inclined at about 60° with respect to the vertical and comprising:

a first upper inwardly curved section descending from the inner edge of said upper face;

a substantially intermediate flat 60° trapezoidal face portion following said first upper curved section;

said trapezoidal flat portion being lifted at its lower end so as to form an angle of between about 7° and 9° with respect to the plane of said oblique portion;

a second lower inwardly curved section between said intermediate flat face and said second end face; and irregular lateral faces connecting said base, said oblique portion, said rectangular lateral faces and merging into said second rectangular end face.

2. Method of chiropractic treatment with a person lying on his back which comprises providing blocks as defined in claim 1, inserting one block underneath said person so as to rest one femoral head on one side of said person against said oblique portion of said one block, said one block being oriented towards the upper part of the body of said person, inserting a second block underneath said person with the oblique portion of said block at the level of the iliac crest on the other side of said person, said second block being in line with said first block but oriented towards the lower part of the body of said person, in such a manner that for each said one and said second blocks, the trapezoidal flat portion presses against the belly of a respective gluteus maximus, while said first and second inwardly curved portions respectively receive portions of the gluteus maximus on both sides of the said belly, thereby bringing about a similar extension of the gluteus maximus on both sides of said belly, said treatment lasting about ten minutes.

* * * * *